US009254708B2

(12) United States Patent
Aikey

(10) Patent No.: US 9,254,708 B2
(45) Date of Patent: Feb. 9, 2016

(54) DECORATIVE BACK APPLIQUÉ FOR FOLDING CHAIRS

(71) Applicant: Marianne Aikey, West Milford, NJ (US)

(72) Inventor: Marianne Aikey, West Milford, NJ (US)

( * ) Notice: Subject to any disclaimer, the term of this patent is extended or adjusted under 35 U.S.C. 154(b) by 0 days.

(21) Appl. No.: 13/960,493

(22) Filed: Aug. 6, 2013

(65) Prior Publication Data

US 2015/0044394 A1 Feb. 12, 2015

(51) Int. Cl.

| | |
|---|---|
| ***A47C 4/04*** | (2006.01) |
| ***B44C 1/10*** | (2006.01) |
| ***A47C 31/00*** | (2006.01) |
| ***A47C 4/20*** | (2006.01) |
| ***A47C 7/40*** | (2006.01) |

(52) U.S. Cl.

CPC . *B44C 1/105* (2013.01); *A47C 4/20* (2013.01); *A47C 7/40* (2013.01); *A47C 31/00* (2013.01)

(58) Field of Classification Search

CPC ..... A47C 1/13; A47C 7/42; A47C 7/62; A47C 31/00; A47C 4/20; A47C 7/40; G09F 2023/005; B44C 1/105

USPC ..... 297/16.1, 46, 47, 48, 49, 188.04, 297/188.07, 463.2; 40/320

See application file for complete search history.

(56) References Cited

U.S. PATENT DOCUMENTS

| | | | | |
|---|---|---|---|---|
| 1,304,753 | A * | 5/1919 | Dwyer | 297/218.4 |
| 5,720,515 | A * | 2/1998 | Haffner | 297/188.04 |
| 5,779,317 | A * | 7/1998 | Neal | 297/440.2 |
| 6,899,391 | B1 * | 5/2005 | Schneller et al. | 297/252 |
| 7,121,621 | B1 * | 10/2006 | Starheim et al. | 297/188.04 |
| 7,131,225 | B2 * | 11/2006 | Wu | 40/320 |
| 8,091,959 | B2 * | 1/2012 | Berger et al. | 297/163 |
| 2002/0047294 | A1 * | 4/2002 | Ellinidis | A47C 1/13 297/188.04 |
| 2005/0151409 | A1 * | 7/2005 | Infanti | A47C 4/02 297/440.2 |
| 2011/0175403 | A1 * | 7/2011 | Kinskey et al. | 297/16.1 |

* cited by examiner

*Primary Examiner* — Philip Gabler

(57) ABSTRACT

A system for a decorative back appliqué includes a folding chair, a top decorative appliqué, a bottom decorative appliqué, and at least one attachment mechanism. The appliqués allow hosts to decorate both rounded and rectangular backed folding chairs used at any occasion or event so that the chairs will provide aesthetic appeal for the celebration. The appliqués adhere to the rear panels of the folding chair using the attachment mechanism, which may be either a magnetic layer or a plurality of adhesive strips. Hosts may choose from many different designs or create their own design or logo for the appliqués to represent the occasion. The system for a decorative back appliqué covers the typical bland panels of folding chairs and instead embellishes the chairs.

14 Claims, 10 Drawing Sheets

DECORATIVE BACK APPLIQUÉ FOR FOLDING CHAIRS

FIELD OF THE INVENTION

The present invention relates generally to a decorative back appliqué for folding chairs. More particularly, its objective is to embellish folding chairs for various purposes and occasions.

BACKGROUND OF THE INVENTION

Folding chairs have been used ubiquitously and frequently for temporary seating because of their convenience. Since they can be purchased at a relatively inexpensively price when compared to other chairs, folding chairs are often used for occasions with large gatherings. Most hosts will choose to purchase low-range folding chairs, the most inexpensive type, to accommodate their guests. These low-range folding chairs, and even mid-range folding chairs, often lack aesthetic appeal and appear plain-looking. These dull folding chairs can in turn decrease the elegance or celebratory appeal of the occasion. Some hosts use folding chair covers to conceal the plain folding chairs, however, these covers can become soiled easily and if only used for a one-time occasion, can also be an unworthy investment for hosts. A worthy investment for a host would be a decorative addition for a plain metal or plastic folding chair that would give the folding chair beauty without throwing a sheet over it to hide it. Since everyone hosts special occasions with folding chairs, an addition to a folding chair to make them part of a celebration would make the occasion more aesthetically appealing.

It is therefore an object of the present invention to introduce an ornamental back appliqué for folding chairs that will not only add aesthetic appeal to the folding chairs and the occasion, but also will cater to a host's needs and desires.

DETAIL DESCRIPTIONS OF THE INVENTION

All illustrations of the drawings are for the purpose of describing selected versions of the present invention and are not intended to limit the scope of the present invention.

Figure 1:
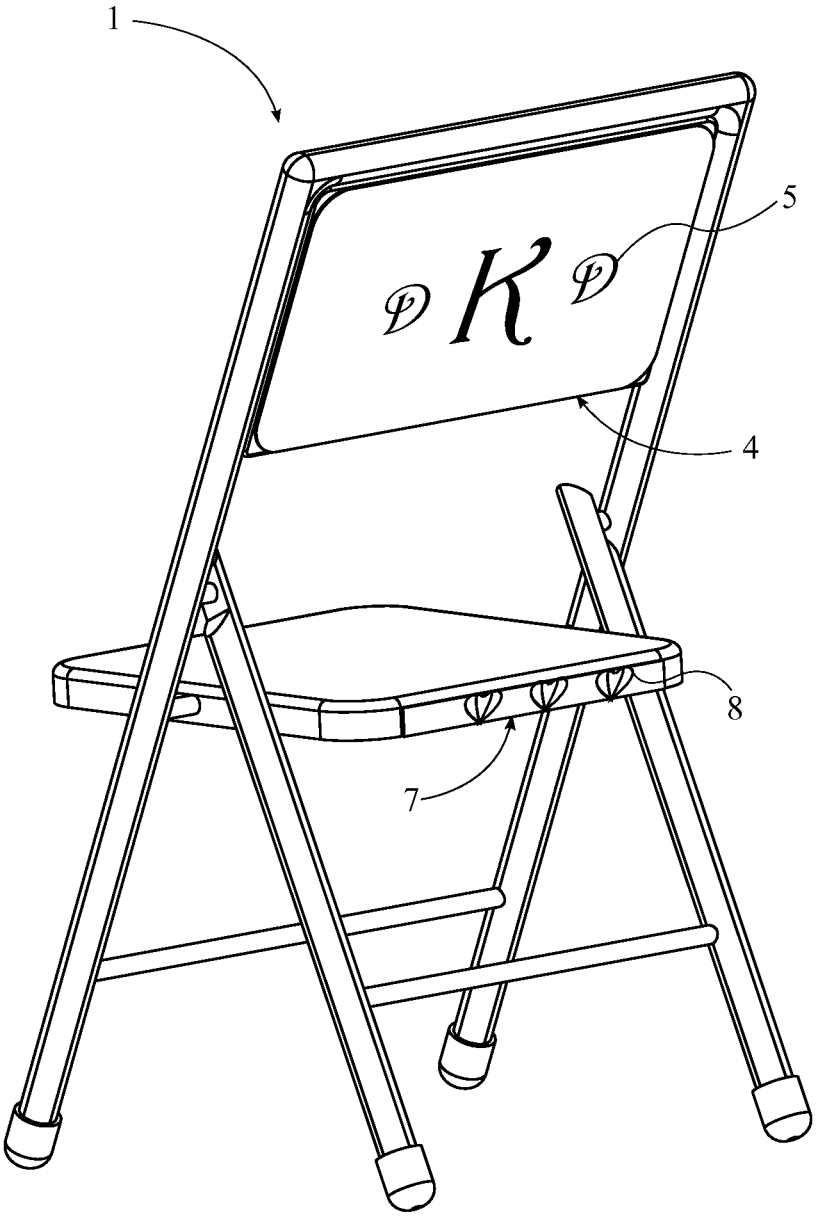
FIG. 1 is a rear perspective view of a system for the present invention.
Figure 2:
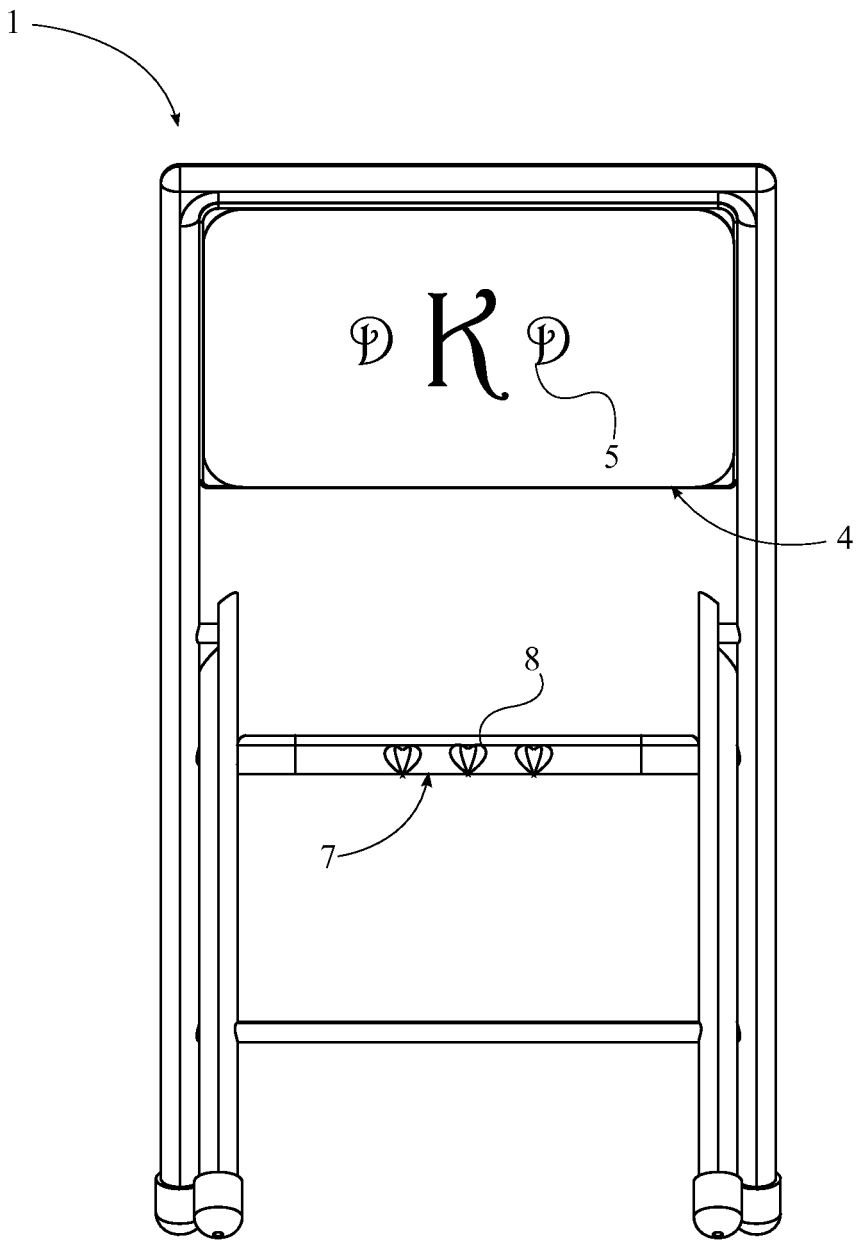
FIG. 2 is a rear view of a system for the present invention.

As can be seen in FIG. 1 and FIG. 2, the present invention is a decorative back appliqué for folding chairs. The present invention attaches to the back of a folding chair for a host to use for special occasions and gatherings. A system for a decorative back appliqué for folding chairs comprises a folding chair 1, a top decorative appliqué 4, a bottom decorative appliqué 7, and at least one attachment mechanism 10. The top decorative appliqué 4 and the bottom decorative appliqué 7 adhere to the folding chair 1 by the at least one attachment mechanism 10.

The folding chair 1 provides the attachment surfaces for the top decorative appliqué 4 and the bottom decorative appliqué 7. The folding chair 1 comprises a rear back panel 2 and a rear seat panel 3, which can be seen more clearly in FIG. 3 and FIG. 5. The rear back panel 2 and the rear seat panel 3 are positioned on the folding chair 1, with the rear back panel 2 positioned above the rear seat panel 3. The rear back panel 2 is either, but is not limited to, a rectangular shape or a rounded shape.

The top decorative appliqué 4 and the bottom decorative appliqué 7 provide the aesthetic ornamental feature for the folding chair 1. The top decorative appliqué 4 comprises a top printed graphic 5 and a top back side 6; the top decorative appliqué 4 is shaped to correlate with the shape of the rear back panel 2. The bottom decorative appliqué 7 comprises a bottom printed graphic 8 and a bottom back side 9. The top printed graphic 5 is oppositely positioned from the top back side 6, and the bottom printed graphic 8 is oppositely positioned from the bottom back side 9.

The at least one attachment mechanism 10 may be either, but is not limited to, a magnetic layer 11, or a plurality of adhesive strips 12. The type of the at least one attachment mechanism 10 used is determined by the type of folding chair 1 that is used. The magnetic layer 11 is preferably used for, but is not limited to, metal folding chairs. This magnetic layer 11 has vinyl coating that is durable, water resistant, and will stick to the chair quickly and efficiently. The magnetic layer may also be a plurality of magnetic strips. An alternative option for metal folding chairs is having the top decorative appliqué 4 and the bottom decorative appliqué 7 made from, but not limited to, a durable paper material. The plurality of adhesive strips 12 is preferably used for, but is not limited to, plastic chairs. The plastic chair uses a top decorative appliqué 4 and a bottom decorative appliqué 7 made from durable paper or vinyl.

Figure 3:
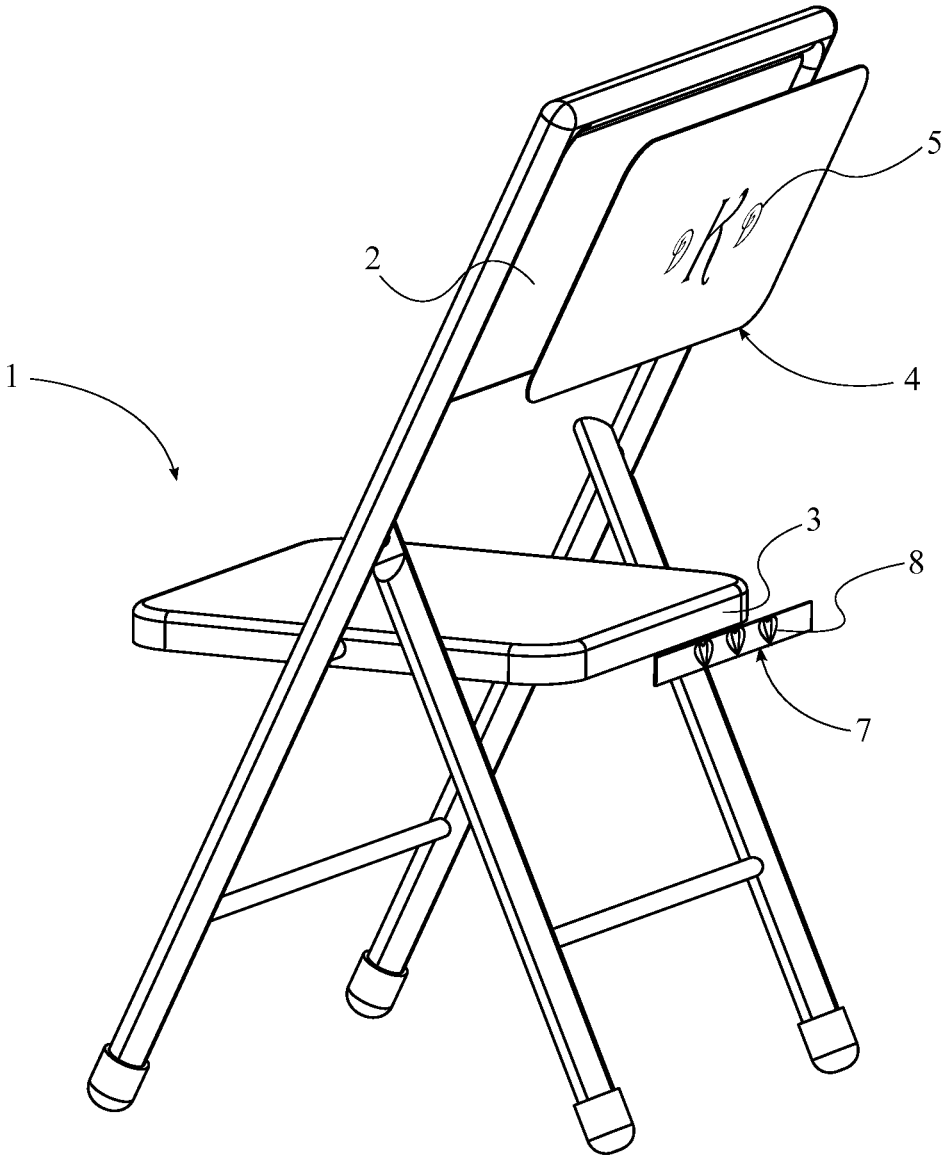
FIG. 3 is a rear exploded perspective view of a system for the present invention with a magnetic layer attachment.
Figure 4:
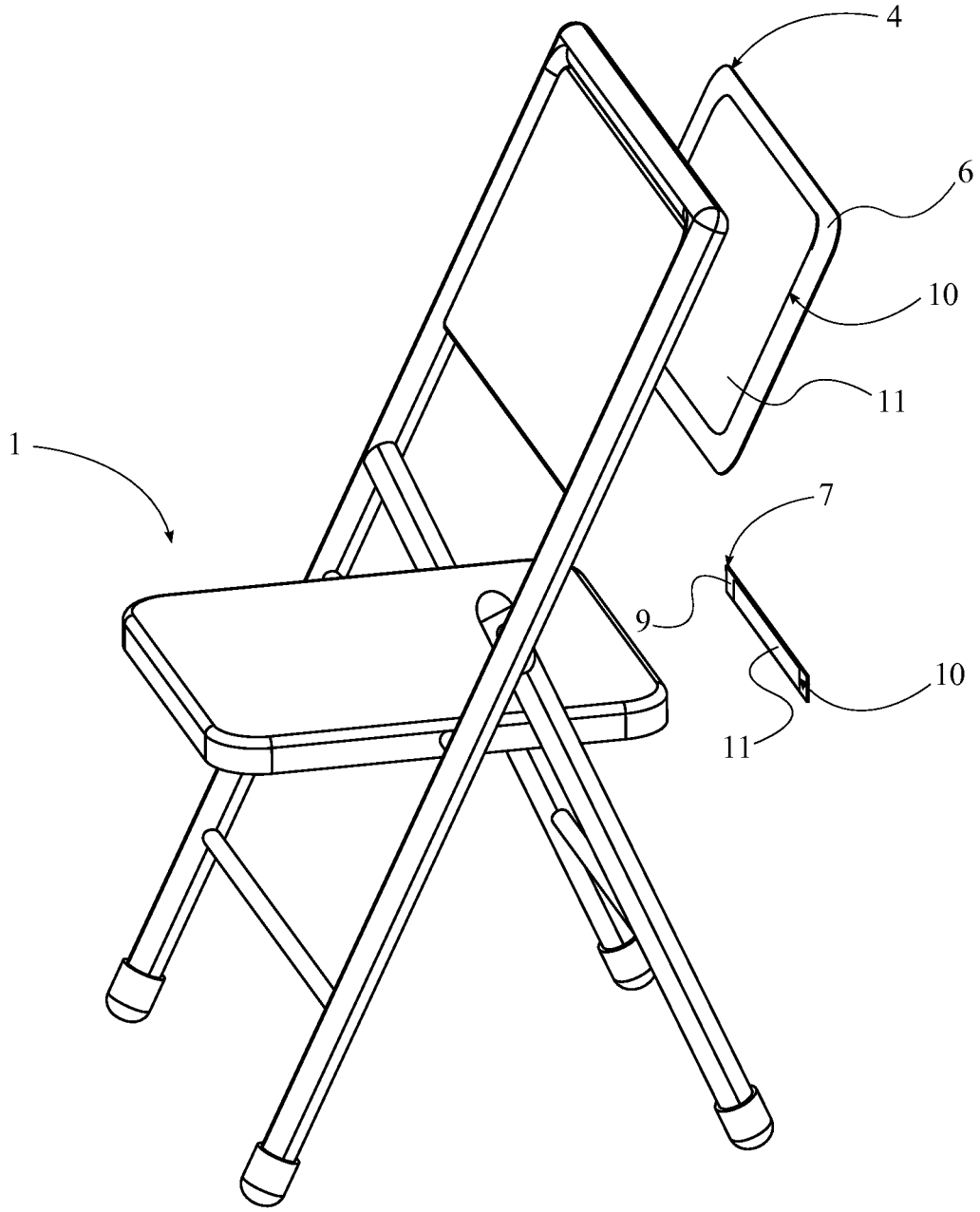
FIG. 4 is a front exploded perspective view of a system for the present invention with a magnetic layer attachment.
Figure 5:
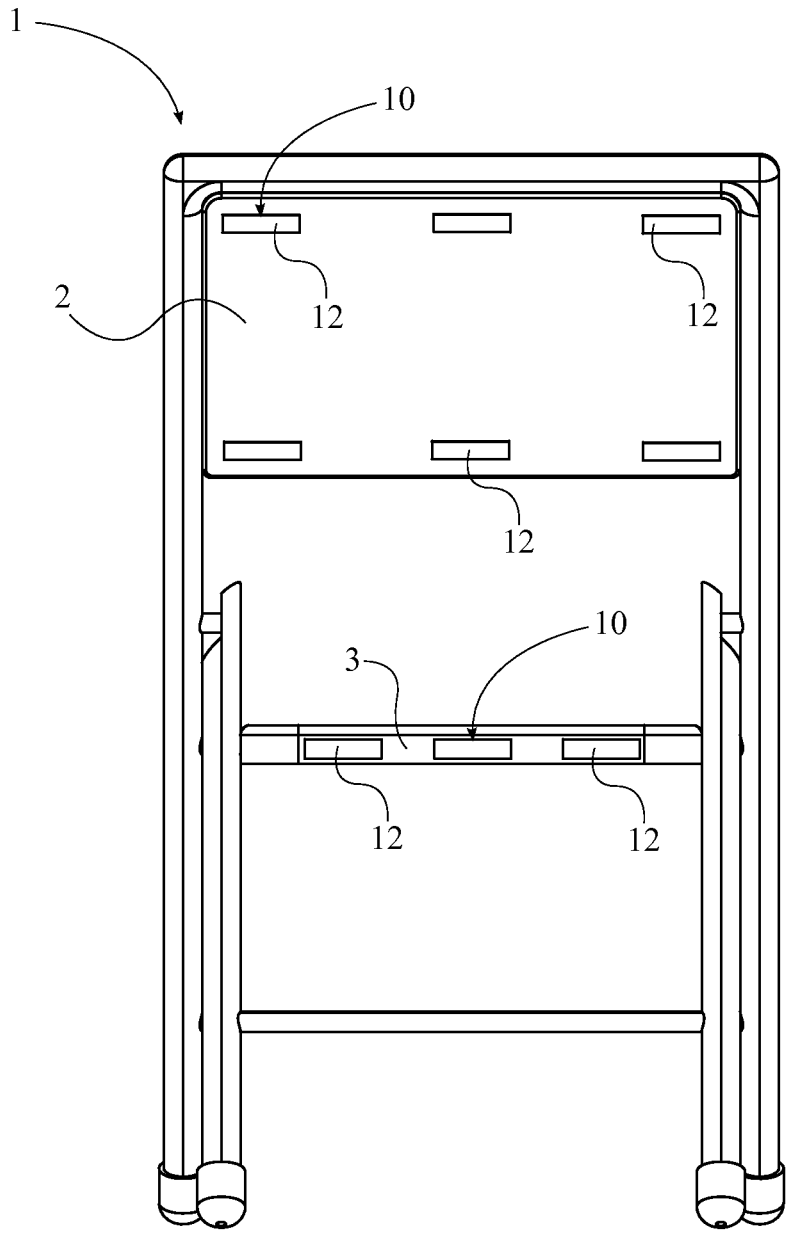
FIG. 5 is a rear view of a system for the present invention, revealing a plurality of adhesive strips.
Figure 6:
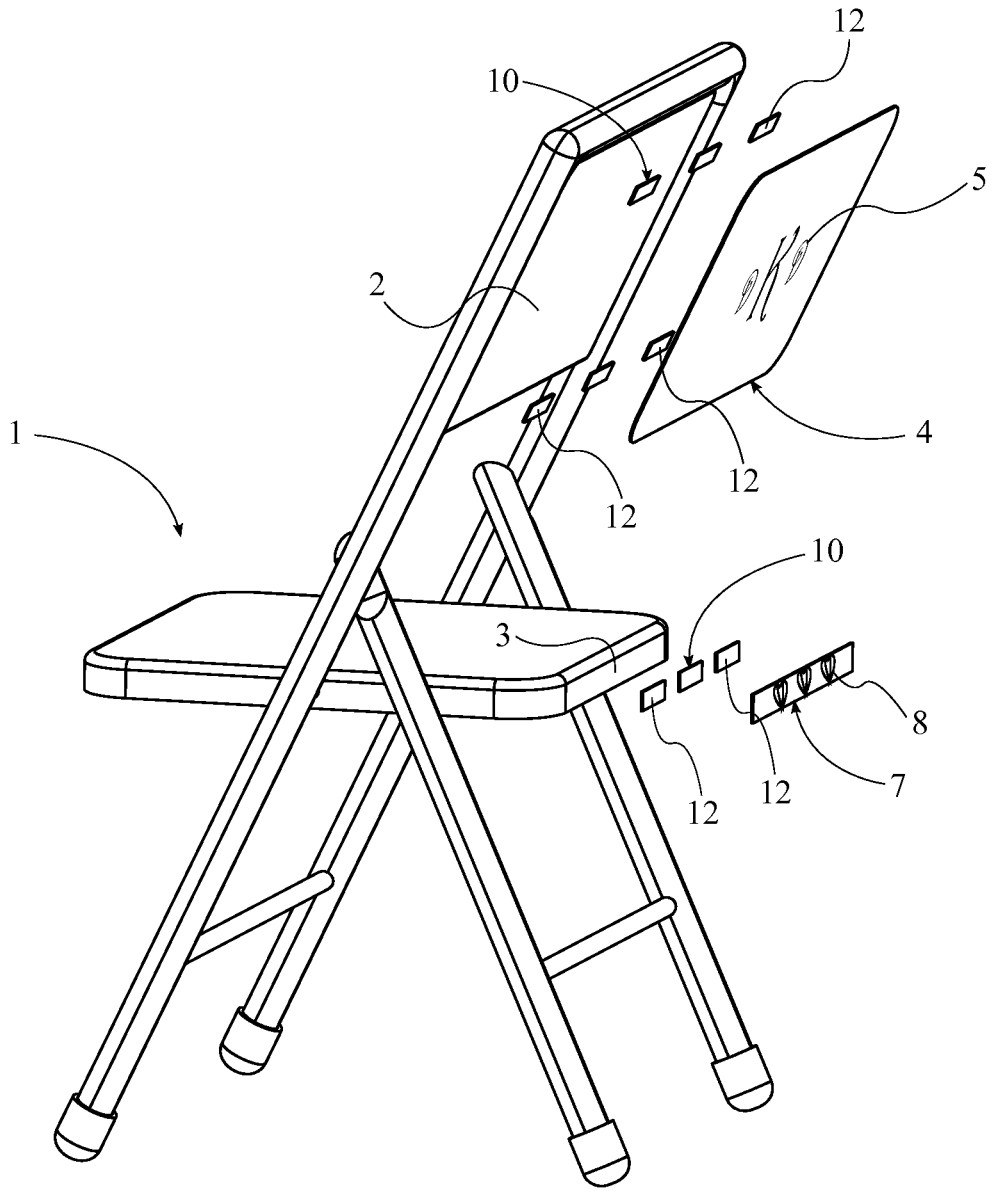
FIG. 6 is a rear exploded perspective view of a system for the present invention with a plurality of adhesive strips.
Figure 7:
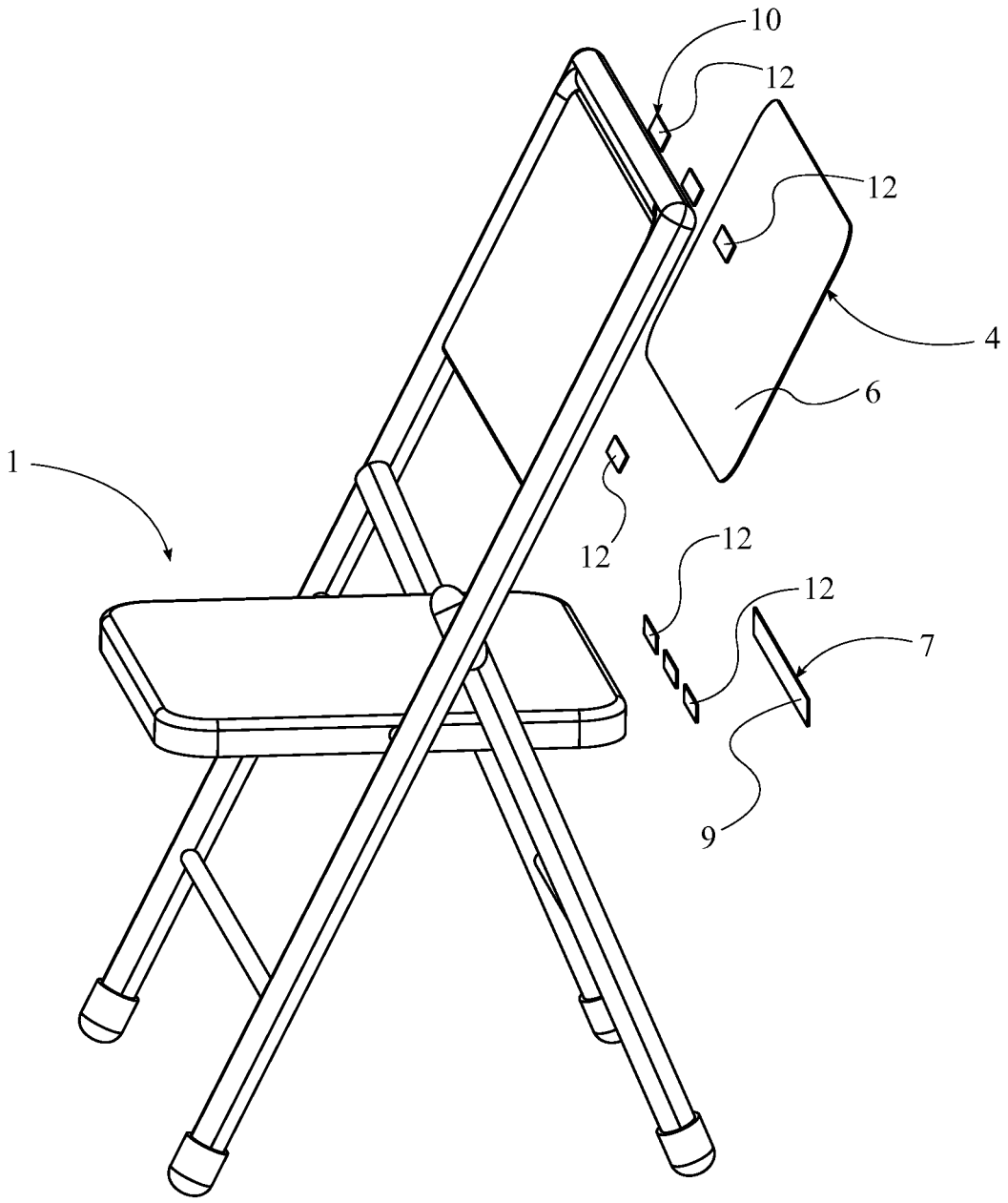
FIG. 7 is a front exploded perspective view of a system for the present invention with a plurality of adhesive strips.

The top back side 6 of the present invention is adjacently attached to the rear back panel 2 by the at least one attachment mechanism 10, which is positioned in between the top back side 6 and the rear back panel 2. If the at least one attachment mechanism 10 is a magnetic layer 11, the magnetic layer 11 is adjacently connected to the top back side 6, as can be seen in FIG. 3 and FIG. 4. If the at least one attachment mechanism 10 is a plurality of adhesive strips 12 positioned in between the top back side 6 and the rear back panel 2, the plurality of adhesive strips 12 is arranged perimetrically for the top back side 6 and the rear back panel 2, as can be seen in FIG. 5, FIG. 6, and FIG. 7.

The bottom back side 9 of the present invention is adjacently attached to the rear seat panel 3 by the at least one attachment mechanism 10 as well, which is positioned in between the bottom back side 9 and the rear seat panel 3. If the at least one attachment mechanism 10 is a magnetic layer 11, the magnetic layer 11 is adjacently connected to the bottom back side 9, as can be seen in FIG. 3 and FIG. 4. If the at least one attachment mechanism 10 is a plurality of adhesive strips 12 positioned in between the bottom back side 9 and the rear seat panel 3, the plurality of adhesive strips 12 is arranged linearly for the bottom back side 9 and the rear seat panel 3, as can be seen in FIG. 5, FIG. 6, and FIG. 7. The bottom decorative appliqué 7 is preferably attached to folding chairs that have thicker rear seat panel. A thicker rear seat panel provides room to add the bottom decorative appliqué 7, which can showcase a design, web address, or the date of the event.

Figure 8:
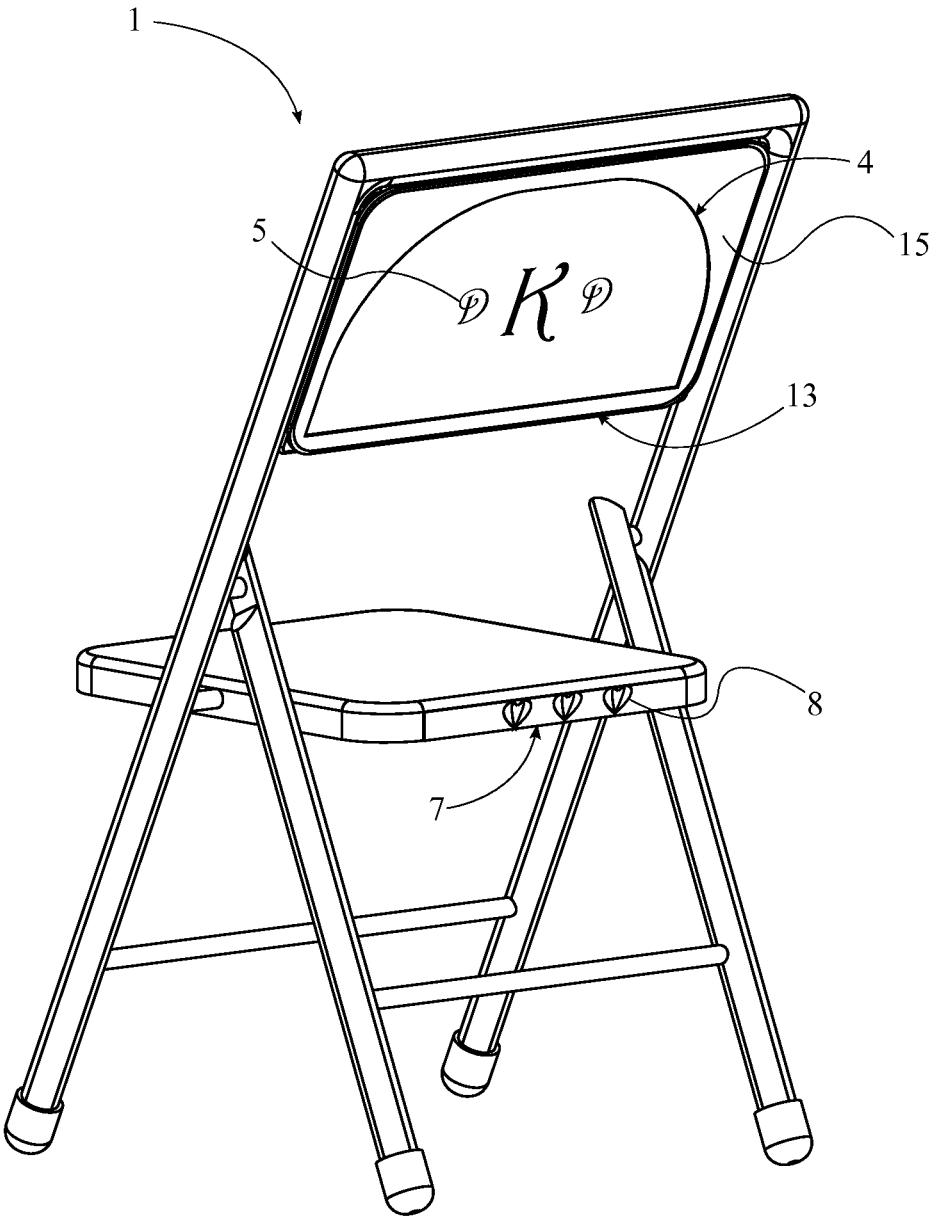
FIG. 8 is a rear perspective view of a system for the present invention with an optional conformable frame.

A second embodiment of the present invention comprises the aforementioned components, as well as a conformable frame 13, as can be seen in FIG. 8. The conformable frame 13 comprises a back frame 14 and a front conforming part 15, which can be seen more clearly in FIG. 9 and FIG. 10. The back frame 14 is a frame where the top decorative appliqué 4 is placed, similar to the way in which a photograph places into a frame. The front conforming part 15 places on top of the top decorative appliqué 4 and into the back frame 14. The front conforming part 15 has a shaped aperture. This optional conformable frame 13 can give a rounded rear back panel a square opening, or give a more rectangular rear back panel 2 a softer, rounded opening, as seen in FIG. 10. The conformable frame 13 allows users to display the top decorative appliqué 4 with a shape different from the original rear back panel 2.

Figure 9:
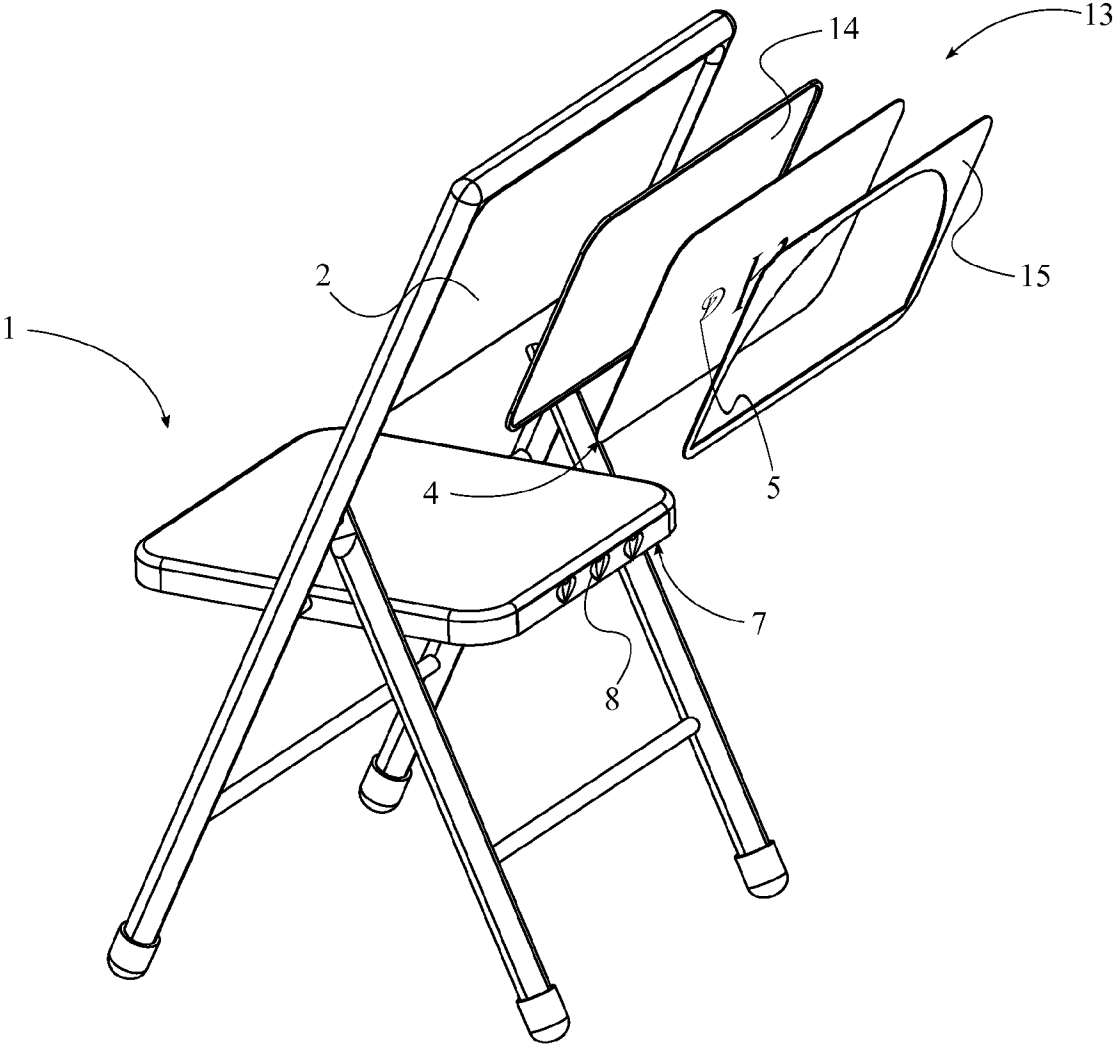
FIG. 9 is a rear exploded perspective view of a system for the present invention with an optional conformable frame.
Figure 10:
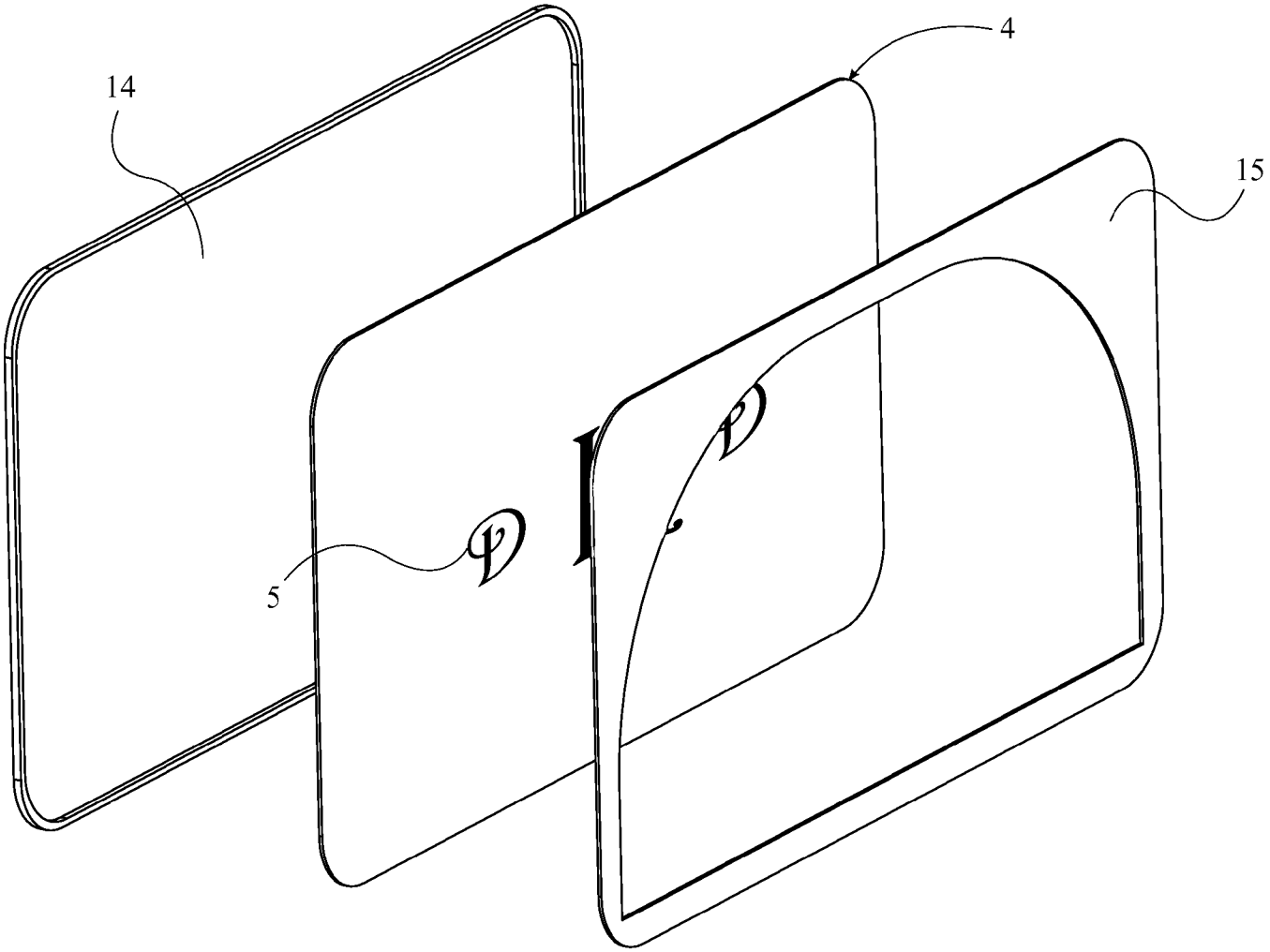
FIG. 10 is an exploded perspective view of an optional conformable frame.

For the second embodiment of the present invention, the top back side 6 is adjacently attached to the back frame 14, and the top printed graphic 5 is oppositely positioned from the rear back panel 2, as can be seen in FIG. 9. The back frame 14 is adjacently attached to the rear back panel 2 by the at least one attachment mechanism 10, which is positioned in between the back frame 14 and the rear back panel 2. If the at least one attachment mechanism 10 is a magnetic layer 11, the magnetic layer 11 is adjacently connected to the back frame 14. The front conforming part 15 is adjacently attached to the top decorative appliqué 4, which is positioned in between the back frame 14 and the front conforming part 15. If the at least one attachment mechanism 10 is a plurality of adhesive strips 12 positioned in between the back frame 14 and the rear back panel 2, the plurality of adhesive strips 12 is arranged perimetrically for the back frame 14 and the rear back panel 2. The front conforming part 15 is adjacently attached to the top decorative appliqué 4, which is positioned in between the back frame 14 and the front conforming part 15.

For the second embodiment of the present invention, the bottom decorative appliqué 7 is attached to the folding chair 1 in the same manner as that of the preferred embodiment of the present invention. The bottom back side 9 is adjacently attached to the rear seat panel 3 by the at least one attachment mechanism 10 as well, which is positioned in between the bottom back side 9 and the rear seat panel 3. If the at least one attachment mechanism 10 is a magnetic layer 11, the magnetic layer 11 is adjacently connected to the bottom back side 9. If the at least one attachment mechanism 10 is a plurality of adhesive strips 12 positioned in between the bottom back side 9 and the rear seat panel 3, the plurality of adhesive strips 12 is arranged linearly for the bottom back side 9 and the rear seat panel 3.

More specifically, hosts may choose to also place the top decorative appliqué 4 on the front back panel instead so that the top back side 6 adjacently attaches to the front back panel via the at least one attachment mechanism 10. The top decorative appliqué 4 may also have a border to match the color of the folding chair 1. Alternatively, the top decorative appliqué 4 may be designed to leave a ¼ inch margin between it and the rear back panel 2 to allow for a border around the top decorative appliqué 4.

More specifically, the host may choose to use a weaker plurality of adhesive strips 12 if the duration the top decorative appliqué 4 and the bottom decorative appliqué 7 are on the folding chair 1 is short or temporary; in this case, the host may choose a different plurality of adhesive strips 12 such as, but not limited to, double-sided tape. If the host is using the present invention for a relatively permanent time period, a stronger plurality of adhesive strips 12 is recommended, such as, but not limited to, a hook-and-loop fastener.

More specifically, if the plurality of adhesive strips 12 are used as the at least one attachment mechanism 10, the plurality of adhesive strips 12 should be placed in, but is not limited to, the fashion shown in FIG. 5. This arrangement of the plurality of adhesive strips 12 prevents the top decorative appliqué 4 and the bottom decorative appliqué 7 from falling off the folding chair 1 and provides an efficient use of the plurality of adhesive strips 12. The top decorative appliqué 4 and the bottom decorative appliqué 7 may also be made of, but not limited to, paper or reusable material. The host may desire for the present invention to be made of paper for a one-time occasion. Hosts that desire a paper version of the present invention may opt for an adhesive back so that the paper version is attached to the folding chair 1 similarly in the way a sticker attaches to a surface. Hosts may also choose to use a weaker plurality of adhesive strips 12 if they are purchasing the present invention for temporary use. If intending to reuse the present invention, the host may choose to select a reusable version of the present invention that attaches to the panels of the folding chair 1 via an alternative plurality of adhesive strips 12 such as, but not limited to, a hook-and-loop fastener.

The preferred embodiment of the present invention has many different designs suitable for a wide range of applications and hosts. For weddings, brides and grooms may choose from fancy monogram initials, a single letter, an elegant wedding pattern, and even a color to match the table cloths or color scheme of the wedding for the top printed graphic 5 and the bottom printed graphic 8. For their grand anniversary, married couples may choose to inform guests of the number of years for which the couple has been together by having the numeral on the top printed graphic 5 and bottom printed graphic 8. Company-hosted events may choose to feature their own unique logo, or their own design for the present invention. Parents hosting their child's birthday party may choose from different birthday-associated logos and representations of the child's age on the present invention. Parents of graduates hosting a celebration may choose from designs associated with graduation, as well as decorative words and the graduating year for both the top decorative appliqué 4 and the bottom decorative appliqué 7. The present invention may also include designs for Confirmation, communion, and other religious gatherings. Hosts may also choose from a solid color for the present invention or they may design their own top printed graphic 5 and bottom printed graphic 8 for the present invention.

Although the invention has been explained in relation to its preferred embodiment, it is to be understood that many other possible modifications and variations can be made without departing from the spirit and scope of the invention as hereinafter claimed.

What is claimed is:

1. A system for a decorative back appliqué for folding chairs comprises:

a folding chair;

a top decorative appliqué;

a bottom decorative appliqué;

at least one attachment mechanism and at least one second attachment mechanism;

the folding chair comprises a rearwardly facing seatback panel surface and a rearwardly facing seat bottom panel surface;

the top decorative appliqué comprises a top printed graphic and a top back side;

the bottom decorative appliqué comprises a bottom printed graphic and a bottom back side;

the top back side being adjacently attached to the seatback panel surface by the at least one first attachment mechanism;

the at least one first attachment mechanism being positioned in between the top back side and the seatback panel surface;

the bottom back side being adjacently attached to the seat bottom panel surface by the at least one second attachment mechanism; and the at least one second attachment mechanism being positioned in between the bottom back side and the seat bottom panel surface.

2. The system for a decorative back appliqué for folding chairs as claimed in claim 1 comprises:

the rear back panel and the rear seat panel being positioned on the folding chair; and the seatback panel surface being positioned above the seat bottom panel surface.

3. The system for a decorative back appliqué for folding chairs as claimed in claim 1 comprises:

the top printed graphic being oppositely positioned from the top back side; and the bottom printed graphic being oppositely positioned from the bottom back side.

4. The system for a decorative back appliqué for folding chairs as claimed in claim 1 comprises:

the at least one first attachment mechanism being a magnetic layer; and the magnetic layer being adjacently connected to the top back side.

5. The system for a decorative back appliqué for folding chairs as claimed in claim 1 comprises:

the at least one first attachment mechanism being a plurality of adhesive strips positioned in between the top back side and the seatback panel surface; and the plurality of adhesive strips being arranged perimetrically for the top back side and the seatback panel surface.

6. The system for a decorative back appliqué for folding chairs as claimed in claim 1 comprises:

the at least one second attachment mechanism being a magnetic layer; and the magnetic layer being adjacently connected to the bottom back side.

7. The system for a decorative back appliqué for folding chairs as claimed in claim 1 comprises:

the at least one second attachment mechanism being a plurality of adhesive strips positioned in between the bottom back side and the seat bottom panel surface; and the plurality of adhesive strips being arranged linearly for the bottom back side and the seat bottom panel surface.

8. A system for a decorative back appliqué for folding chairs comprises:

a folding chair;

a top decorative appliqué;

a bottom decorative appliqué at least one first attachment mechanism and at least one second attachment mechanism;

a conformable frame;

the folding chair comprises a rearwardly facing seatback panel surface and rearwardly facing seat bottom panel surface;

the top decorative appliqué comprises a top printed graphic and a top back side;

the bottom decorative appliqué comprises a bottom printed graphic and a bottom back side;

the conformable frame comprises a back frame and a front conforming part;

the top back side being adjacently attached to the back frame;

the top printed graphic being oppositely positioned from the seatback panel surface;

the back frame being adjacently attached to the seatback panel surface by the at least one first attachment mechanism;

the at least one first attachment mechanism being positioned in between the back frame and the seatback panel surface;

the bottom back side being adjacently attached to the seat bottom panel surface by the one second attachment mechanism; and the at least one second attachment mechanism being positioned in between the bottom back side and the seat bottom panel surface.

9. The system for a decorative back appliqué for folding chairs as claimed in claim 8 comprises:

the seatback panel surface and the seat bottom panel surface being positioned on the folding chair; and the seatback panel surface being positioned above the seat bottom panel surface.

10. The system for a decorative back appliqué for folding chairs as claimed in claim 8 comprises:

the top printed graphic being oppositely positioned from the top back side; and the bottom printed graphic being oppositely positioned from the bottom back side.

11. The system for a decorative back appliqué for folding chairs as claimed in claim 8 comprises:

the at least one first attachment mechanism being a magnetic layer;

the magnetic layer being adjacently connected to the back frame;

the front conforming part being adjacently attached to the top decorative appliqué; and the top decorative appliqué being positioned in between the back frame and the front conforming part.

12. The system for a decorative back appliqué for folding chairs as claimed in claim 8 comprises:

the at least one first attachment mechanism being a plurality of adhesive strips positioned in between the back frame and the seatback panel surface;

the plurality of adhesive strips being arranged perimetrically for the back frame and the seatback panel surface;

the front conforming part being adjacently attached to the top decorative appliqué; and the top decorative appliqué being positioned in between the back frame and the front conforming part.

13. The system for a decorative back appliqué for folding chairs as claimed in claim 8 comprises:

the at least one second attachment mechanism being a magnetic layer; and the magnetic layer being adjacently connected to the bottom back side.

14. The system for a decorative back appliqué for folding chairs as claimed in claim 8 comprises:

the at least one second attachment mechanism being a plurality of adhesive strips positioned in between the bottom back side and the seat bottom panel surface; and the plurality of adhesive strips being arranged linearly for the bottom back side and the seat bottom panel surface.

* * * * *